US010981701B2

(12) United States Patent
Giraud et al.

(10) Patent No.: US 10,981,701 B2
(45) **Date of Patent: *Apr. 20, 2021**

(54) TAB RELEASE CHILD SAFETY FEATURE

(71) Applicant: CSP TECHNOLOGIES, INC., Auburn, AL (US)

(72) Inventors: Jean-Pierre Giraud, Auburn, AL (US); Michel Zbirka, Jouy-sur-Morin (FR); Joseph W. Rogers, Lafayette Hill, PA (US)

(73) Assignee: CSP TECHNOLOGIES, INC., Auburn, AL (US)

( * ) Notice: Subject to any disclaimer, the term of this patent is extended or adjusted under 35 U.S.C. 154(b) by 24 days.

This patent is subject to a terminal disclaimer.

(21) Appl. No.: 16/279,800

(22) Filed: Feb. 19, 2019

(65) Prior Publication Data

US 2019/0202606 A1 Jul. 4, 2019

Related U.S. Application Data

(63) Continuation of application No. 14/837,018, filed on Aug. 27, 2015, now Pat. No. 10,239,668, which is a (Continued)

(51) Int. Cl.
*B65D 43/02* (2006.01)
*B65D 50/04* (2006.01)
(Continued)

(52) U.S. Cl.
CPC ..... *B65D 43/0202* (2013.01); *B65D 47/0804* (2013.01); *B65D 50/00* (2013.01);
(Continued)

(58) Field of Classification Search
CPC .... B65D 43/0202; B65D 50/00; B65D 50/06; B65D 47/0804; B65D 50/045; B65D 2215/02
See application file for complete search history.

(56) References Cited

U.S. PATENT DOCUMENTS 4,022,352 A 5/1977 Pehr
4,170,315 A 10/1979 Dubach et al.
(Continued)

FOREIGN PATENT DOCUMENTS

EP 2050685 A1 4/2009

OTHER PUBLICATIONS

International Search Report for PCT/US07/06693, dated Jun. 10, 2008.
Written Opinion for PCT/US07/06693, dated Jun. 10, 2008.

*Primary Examiner* — James N Smalley
(74) *Attorney, Agent, or Firm* — Mark T. Vogelbacker; Eckert Seamans Cherin & Mellott, LLC

(57) ABSTRACT

A child-resistant container including a container body, a lid, and at least one resilient tab is provided. The lid is pivotable about an axis through a hinge joining the lid to the container body to open and close the container. The resilient tab has a proximal portion fixed to the lid, a distal portion projecting from the lid, and at least one abutment on the distal portion. The abutment on the distal portion of the tab is normally biased into engagement with an abutment on the container body when the lid is in its closed position. The distal portion of the tab is displaceable against the bias to disengage the abutment of the tab from the abutment of the container. Displacement of the tab releases the lid so that it can be pivoted about the hinge to open the container.

20 Claims, 13 Drawing Sheets

Related U.S. Application Data continuation of application No. 14/170,214, filed on Jan. 31, 2014, now Pat. No. 9,150,399, which is a continuation of application No. 12/997,507, filed as application No. PCT/US2007/006693 on Mar. 16, 2007, now Pat. No. 8,807,359.

(60) Provisional application No. 60/743,759, filed on Mar. 24, 2006, provisional application No. 60/783,637, filed on Mar. 17, 2006.

(51) Int. Cl.
*B65D 47/08* (2006.01)
*B65D 50/06* (2006.01)
*B65D 50/00* (2006.01)

(52) U.S. Cl.
CPC ..... *B65D 50/045* (2013.01); *B65D 50/06* (2013.01); *B65D 2215/02* (2013.01)

(56) References Cited

U.S. PATENT DOCUMENTS

| | | | | |
|---|---|---|---|---|
| 4,244,495 | A | 1/1981 | Lorscheid et al. | |
| 4,429,800 | A * | 2/1984 | Greenspan | B65D 50/045 215/216 |
| 4,746,008 | A | 5/1988 | Heverly et al. | |
| 4,809,874 | A | 3/1989 | Pehr | |
| 4,892,208 | A | 1/1990 | Sledge | |
| 4,974,735 | A * | 12/1990 | Newell | B65D 41/58 215/253 |
| 5,031,784 | A | 7/1991 | Wright | |
| 5,040,691 | A | 8/1991 | Hayes et al. | |
| 5,083,671 | A | 1/1992 | Hayes | |
| 5,137,260 | A | 8/1992 | Pehr | |
| 5,270,011 | A | 12/1993 | Altherr | |
| 5,353,946 | A | 10/1994 | Behrend | |
| 5,427,265 | A | 6/1995 | Cautereels et al. | |
| 5,526,953 | A | 6/1996 | Chieng | |
| 5,577,779 | A | 11/1996 | Dangel | |
| 5,636,756 | A | 6/1997 | Johnson | |
| 5,785,179 | A | 7/1998 | Buczwinski et al. | |
| 5,853,093 | A | 12/1998 | Neiger | |
| 6,523,690 | B1 | 2/2003 | Buck et al. | |
| 6,662,454 | B2 | 12/2003 | Harrold | |
| 6,772,902 | B1 | 8/2004 | White | |
| 6,986,434 | B1 | 1/2006 | Getsy et al. | |
| 7,581,656 | B2 | 9/2009 | Gnepper et al. | |
| 7,717,284 | B2 | 5/2010 | Giusti | |
| 7,721,907 | B2 | 5/2010 | Keung | |
| 8,167,156 | B2 | 5/2012 | Milante | |
| 8,172,101 | B2 | 5/2012 | Giusti | |
| 2003/0201283 | A1 | 10/2003 | Branson et al. | |
| 2005/0023285 | A1 | 2/2005 | Keung | |
| 2005/0242105 | A1 | 11/2005 | Homann | |
| 2006/0011573 | A1 * | 1/2006 | Herald | B65D 55/024 215/237 |
| 2006/0186077 | A1 | 8/2006 | Robinson | |
| 2009/0194501 | A1 | 8/2009 | Yamanaka et al. | |

* cited by examiner

TAB RELEASE CHILD SAFETY FEATURE

RELATED APPLICATIONS

This patent application is a continuation of U.S. application Ser. No. 14/837,018 filed Aug. 27, 2015, now pending, which is a continuation of Ser. No. 14/170,214 filed Jan. 31, 2014, now issued U.S. Pat. No. 9,150,339, which is a continuation of U.S. application Ser. No. 12/997,507 filed Dec. 10, 2010, now issued U.S. Pat. No. 8,807,359, which is the U.S. National Stage of International Application No. PCT/US2007/006693 filed Mar. 16, 2007, now expired, which claims priority to U.S. Provisional Patent Application Ser. No. 60/743,759 filed Mar. 24, 2006, and U.S. Provisional Application Ser. No. 60/783,637 filed Mar. 17, 2006. Each application referred to in this paragraph is incorporated here by reference in its entirety to provide continuity of disclosure.

FIELD OF THE INVENTION

The present technology relates to containers having child safety features, and more particularly, to a container and lid assembly that has child safety features.

BACKGROUND OF THE INVENTION

Containers provided with child safety features are well known in the art, particularly in North America, for packaging pharmaceutical products. The child safety feature is also referred to as a Child Resistant Closure (CRC). In general, a child resistant closure must be effective with children under 5-years old and be generally user friendly for users over 50-years old, particularly with users over 60-years old. The US government has established a CR protocol to the evaluate effectiveness of closures. Child Resistant Protocol testing is defined under CFR Title 16, Part 1700 by the Food and Drug Administration. Most of the prior art CRC features employ a separate cap and container, which are distinct from each other. It is desirable to provide a unitary container and cap assembly that has child safety features. Since the cap and container are unitary, that is, in some way attached to one another, the cap cannot be misplaced when the container is opened.

Small containers provide a minimum of area for the user to grasp the lid, manipulate the CR feature and open the lid. It would be desirable to provide a child resistant feature that can operate within a minimum area, making the feature suitable for use with small containers.

SUMMARY OF THE INVENTION

One aspect of the present technology is directed to a child-resistant container including a container body, a lid, and a resilient tab. The container body has a mouth that provides access to the interior of the container body. A downward-facing abutment is provided on or attached to the container body. In one embodiment, the abutment is integral with and projects out from the sidewall of the container body. In another embodiment, the abutment can be formed in a separate part, such as an outer cap, attached to the container body.

The lid can be a flip-top lid or other construction having a proximal portion mounted in pivotable relation to the container body by a hinge and a distal portion. In an embodiment, the lid is an insert joined by the hinge to an outer cap that in turn is mounted on the container body. In another embodiment, the lid can be hinged directly to the container body. The distal portion of the lid is pivotable between a seated position, wherein the lid covers the mouth, and a raised position, wherein the mouth is at least in part exposed.

In one embodiment, the lid includes at least one resilient tab having a proximal portion fixed to the lid, a distal portion projecting from the lid, and at least one upward-facing abutment on the distal portion. The upward-facing abutment is normally biased at least partly beneath and into engagement with the downward-facing abutment on the container body when the lid is seated, thus latching the lid closed. The distal portion of the resilient tab is displaceable against its bias to disengage the upward facing abutment from the downward-facing abutment. This displacement of the distal portion of the resilient tab releases the distal portion of the lid to be pivoted about the hinge to open the container.

In an alternative embodiment, an abutment is provided on or attached to the lid, rather than the container body, and the resilient tab is provided on the container body rather than the lid. In this embodiment, the tab has a downward-facing abutment on the distal portion of the tab that is normally biased into engagement with the abutment on the lid, which is upward-facing. Displacement of the distal portion of the resilient tab releases the lid.

Another aspect of the invention is a unitary (or one-piece) container that incorporates a tab feature as a child resistant mechanism. The tab mechanism restricts the movement of a flip-top lid. The lid is opened by deflecting the tab back (toward the back of the container) so that the tab is free from a catch feature on the container body that prevents the lid from being opened. With the tab being held in a deflected position, the lid can be rotated or flipped open.

Another aspect of the invention is to provide a unitary container that has a moisture-tight seal between the cap portion and the container portion, and incorporates a resealable mechanism to maintain the moisture-tight properties. The resealable mechanism can be created by the interference of the flip-top lid to the body of the container. Another embodiment of a resealable mechanism is a sealing plug extending downwardly from the underside, or closure side, of the flip-top lid and sized and configured to fit within the container opening when the flip-top lid is closed.

DETAILED DESCRIPTION OF THE INVENTION

Figure 1:
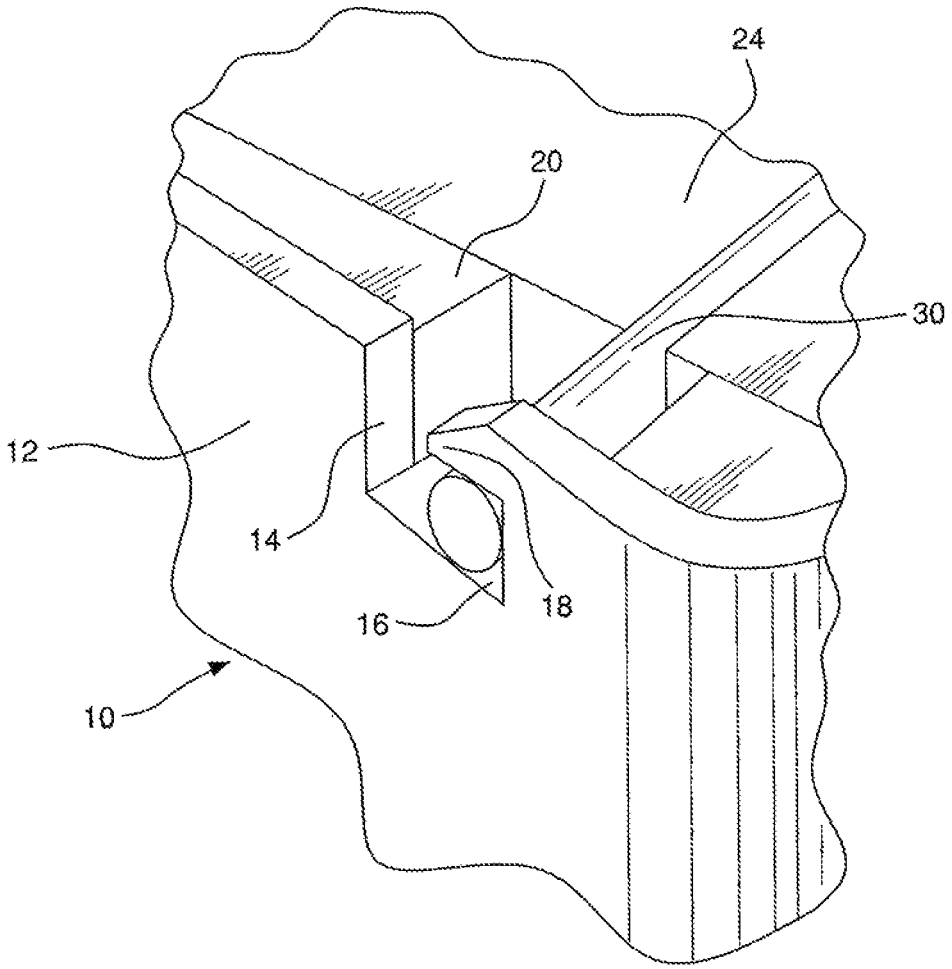
FIG. 1 is a perspective view of the cap and flip-top lid assembly of an embodiment of the invention, showing the lid in closed position and the tab feature in an engaged position.

The container of the present technology has at least two parts, formed integrally or separately: (1) a container body and (2) a cap that incorporates a flip-top lid. The container body is initially formed with an open mouth through which product may be introduced into the container. After the container is filled with product, the cap is inserted into or over the open mouth end of the container to close the mouth of the container. In the case of separately formed parts where the cap is inserted into the open mouth end, an opening in the cap provides access to the product within the container.

When the parts are separate, preferably the cap is permanently fixed to the interior wall of the container body after the container is filled, thereby rendering the container body and cap into a unitary container. The cap may be permanently fixed to the container body by any suitable manner known in the art. For example, the cap and the container body may be sized so as to provide a friction fit for the cap. Alternatively the cap may be permanently attached via a mechanical snap. Although it is preferable to permanently fix the cap to the container body after the container is filled with product, it will be appreciated by those of skill in the art that such permanent fixture may not be necessary.

A lid is attached to the cap and covers the cap opening to prevent product from being removed. To access the product, the lid portion of the cap is flipped open to reveal the opening in the cap.

A flexible component, or tab is incorporated into the lid portion of the cap. When the lid is in the closed position, the tab engages a notch-feature, including a catch, formed on the container body that prevents the lid from being opened. One or more tabs may be used to secure the lid. Alternatively, the tab can be attached to the container body. The tab then engages a catch incorporated into the lid to prevent the lid from being opened. The term "tab" is broadly defined herein to include any projecting member having a deflectable portion.

The tab is designed to be flexible. To open the lid, the tab is deflected or moved in a direction away or opposite from the notch feature or catch on the container or the lid so that the tab can be moved past the catch. Once the tab is clear of the catch, the lid can be flipped open to access the product in the container.

The container and cap are typically made of a polymer material that provides adequate protection for the product packaged in the container. The container and cap do not need to be made from the same polymer material. Depending on the requirements of the pharmaceutical product, barrier materials such as polyvinyl chloride, polyethylene vinyl acetate, polyethylene, polypropylene, and poly vinylidene chloride may be used. In another embodiment, non-barrier materials may also be used. Non-barrier thermoplastic materials include polystyrene, polycarbonate, polyester terephthalate, polybutylene, metallocene catalyzed polyolefins and poly maleic anhydride.

Referring to the drawings, FIG. 1 shows an embodiment of a container 10, useful as a pill bottle, for example. The container 10 has a container wall 12, the upper end of which forms a rim 14. At least one notch 16 is formed into the rim 14 and includes a catch 18 for receiving a child resistant tab 30, as will be explained in more detail below. Preferably, a notch 16, including a catch 18, is formed into the rim on each side of the container, with each notch receiving a tab 30.

A cap 20 is inserted into the upper or mouth end of the container 10 and is preferably permanently fixed to the container to create a unitary container structure. The cap 20 has an opening 22 (See FIG. 2), which provides access to the product. A lid 24 is joined to the cap 20 by a hinge 26 which may be, for example, an integral hinge. The lid 24 overlies the opening 22 to retain product within the container.

Figure 2:
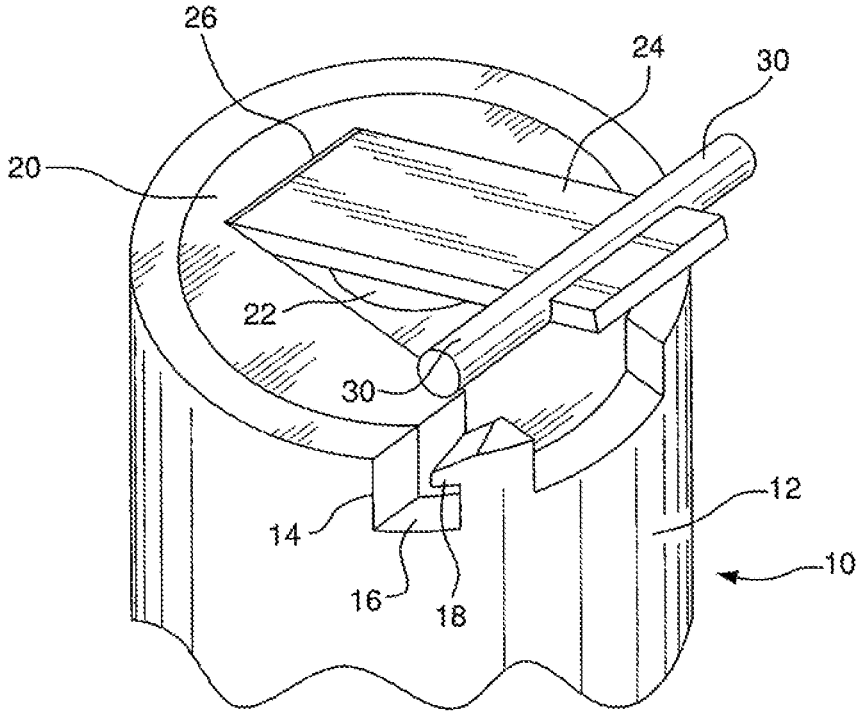
FIG. 2 is a perspective view of the cap and flip-top lid assembly of an embodiment of the invention, showing the lid in open position.

The lid 24 is provided with at least one and, as shown in FIG. 2, preferably two flexible tab elements 30, which extend perpendicularly outwardly from each side of the lid. As best shown in FIG. 1, when the lid is in the closed position, each tab element 30 is seated into a notch 16 in the rim of the container and is retained in the notch 16 by the catch 18. The retaining of each tab element by each notch 18 locks the lid in place, preventing a child from accessing the contents of the container.

The tab elements 30 are flexible and can be flexed or moved toward the back of the container in a direction away from the catch 18. To unlock or release the lid, the tab elements 30 are moved away from the catches 18 until they are clear from the catches. Once the tab elements 30 clear the catches, the lid can be rotated about an axis through the hinge 26 to flip open the lid, as shown in FIG. 2.

In another embodiment of the invention, the container is also moisture-tight and includes a resealable mechanism to maintain the moisture tight properties. A permanent moisture-tight seal is preferably formed between the cap 20 and the interior of the container wall 12. The lid 24 is also provided with a sealing plug (shown in the FIG. 9 embodiment at 23), which is sized and configured to provide an interference fit with the opening 22 and form a moisture-tight seal. Preferably, the sealing plug is integrally molded as part of the lid 24. The sealing plug allows the container to be moisture tight as well as resealable.

The term "resealable" means that the container can be opened/reopened and closed or reclosed a numerous amount of times (e.g. more than 5 times) and still retain its moisture-tight properties. The term "moisture tight" means the moisture ingress of the container was less than about 1500 micrograms/day of water, determined by the following test method: (a) place approximately one gram of molecular sieve in the container and record the weight; (b) close the resealable mechanism; (c) place the sealed container in an environmental chamber at conditions of 80% relative humidity and 72° F.; (d) after one day, weigh the container containing the molecular sieve; (e) after approximately two weeks, weigh the container; and (f) subtract the first day sample from the value obtained and divide by the number of days to calculate the moisture ingress of the container in units of micrograms of water.

In some embodiments, a seal need not be formed, nor is an interference fit essential in some instances, depending on the product intended for the container.

For some embodiments it may be desirable to have a force required to raise the lid 24 so that the lid can not easily be pushed up with just a finger or fingers moving the tab or tabs past the catch. A force of approximately 10 N encourages two-handed operation and is more difficult for a child to overcome. The additional force for raising the lid can be built into the container by, for example, providing an interference fit between the sealing plug on the lid (see FIG. 9) and the opening into the container, or providing an interference fit or mechanical snap between the lid and the cap.

Another embodiment of the invention, shown in FIGS. 3-5 and 9-11, has tabs that extend perpendicularly downward from the side edges of the lid when the lid is in its closed position. A feature or ring of the container protrudes from the front of the container that is a similar shape to the lid, but larger than the lid and such that the lid nests in the feature. When in the closed position, the tabs engage the underside of the protrusion, securing the lid. In order to release the lid, the tabs are deflected inward, away from the protrusion so that they no longer are engaged. The tabs can be connected together by a spring that acts to hold the tabs in position and permits the force needed to release the lid to be adjusted. When the tabs are deflected inward, the lid can be rotated open and the container opened. After use, the container can be closed by simply rotating the lid to the closed position and the tabs are shaped so that they fit through the protrusion and again engage the underside, securing the lid.

Figure 3:
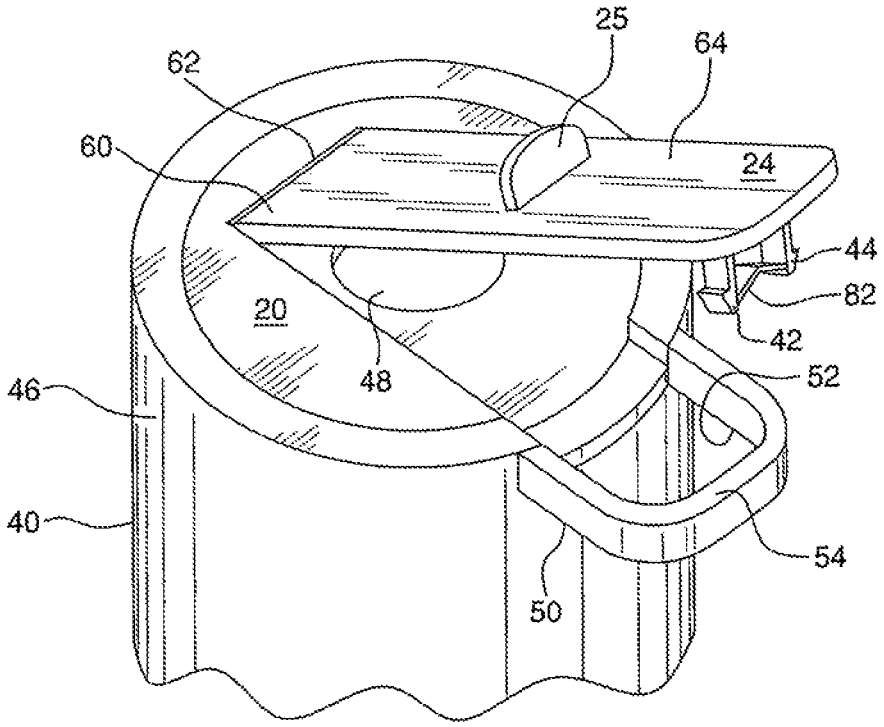
FIG. 3 shows a perspective view of another embodiment of the invention, showing the lid open.
Figure 4:
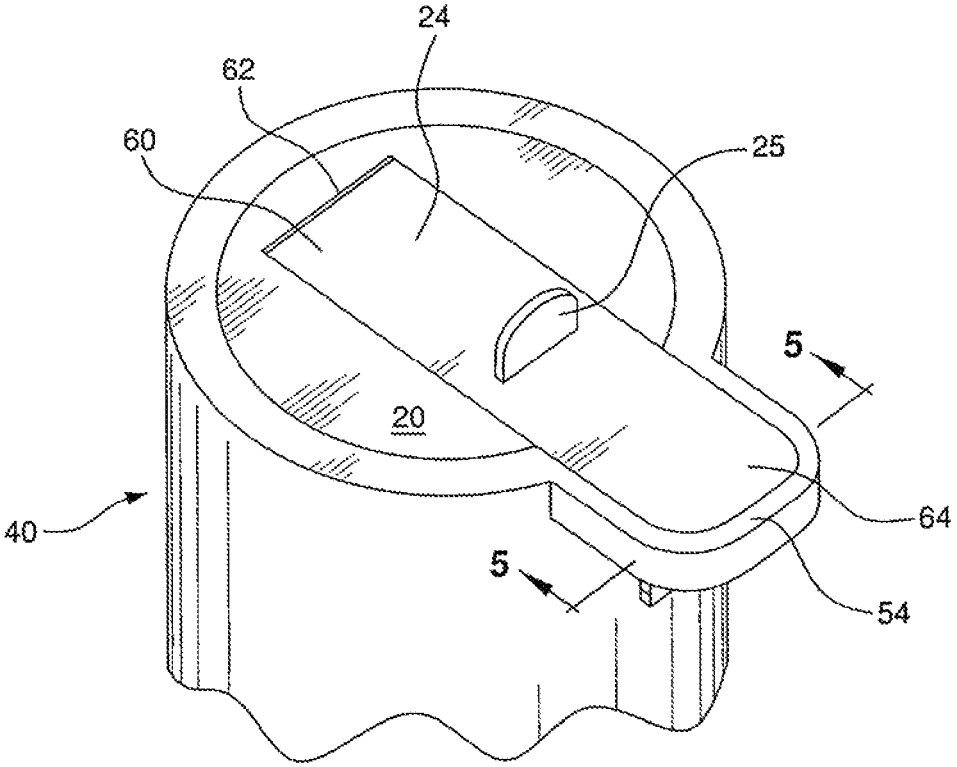
FIG. 4 is a view similar to FIG. 3, showing the lid closed
Figure 5:
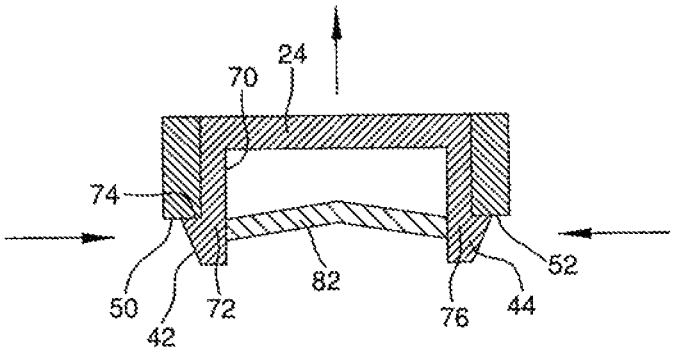
FIG. 5 is a section taken along line 5-5 of FIG. 4.

Referring in more detail to FIGS. 3-5, the child-resistant container 40 includes a lid 24 and a resilient tab, here a pair of tabs 42 and 44. The container 40 may have a generally cylindrical neck 46, here the entire body of the container, alternatively the container may have the reduced-diameter neck of a bottle or jug. In an embodiment the neck defines the top of the container 40. The container 40 has a mouth 48. A downward-facing abutment, in this case the abutments 50 and 52, is provided on or attached to the container. In an embodiment, the abutments 50 and 52 are integral with and project out from the neck 46. Here, a ring or guard 54 defines the abutments 50 and 52. In another embodiment, one or more abutments can be formed in a separate part, such a cap, attached to the container.

The lid 24 in an embodiment can be a flip-top lid or other construction having a proximal portion 60 mounted in pivotable relation to the container by a hinge 62 and a distal portion 64. In an embodiment, the lid 24 is an insert joined by the hinge 62 to an outer cap 20 that in turn is mounted on the container 40. In another embodiment, the lid 24 can be hinged directly to the container 40. The distal portion 64 of the lid 24 is pivotable between a seated position shown in FIG. 4, wherein the lid 24 covers the mouth 48, and a raised position shown in FIG. 3, wherein the mouth 48 is at least in part exposed. The lid 24 can be provided with a vertical protrusion 25 to facilitate lifting the lid 24 to open the container.

The lid 24 includes at least one resilient tab, here the tabs 42 and 44, having a proximal portion such as 70 fixed to the lid 24, a distal portion 72 projecting from the lid 24, and at least one upward-facing abutment 74 on the distal portion 72. The upward-facing abutment 74 is normally biased at least partly beneath and into engagement with the downward-facing abutment such as 50 of the container 40 when the lid 24 is seated, thus latching the lid 24 closed. The distal portion 72 of the resilient tab is displaceable against its bias, as by pinching the distal portions 72 and 76 of the respective tabs 42 and 44 together, to disengage the upward facing abutments such as 74 from the downward-facing abutment such as 50. This displacement of the distal portion of the resilient tabs releases the distal portion 64 of the lid to be pivoted about the hinge 62 to open the container 40.

Figure 11:
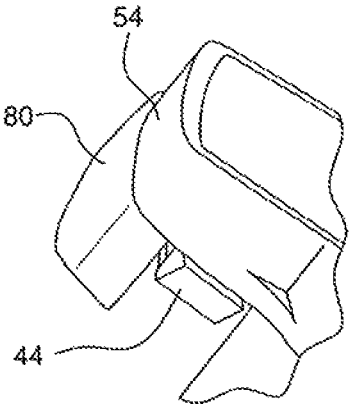
FIG. 11 is a view similar to FIG. 10, showing another embodiment having an additional shield for the tab.

In another embodiment of the invention, shown in FIG. 11, the feature or ring on the container has a depending shield 80 that limits access to the tabs such as 44. In this embodiment, the tabs such as 44 can only be accessed from the sides, further restricting the way in which the container can be opened or the ability of a child to see how to open the container.

Figure 9:
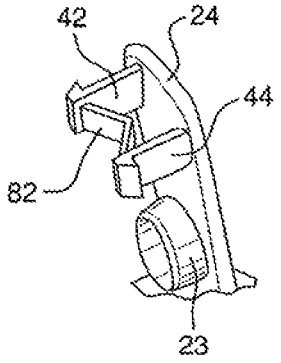
FIG. 9 is an isolated partial perspective view of the lid of FIGS. 3-5.

In a further elaboration of the embodiment shown in FIGS. 3, 5, and 9, a spring 82 is provided between the tabs 42 and 44 to stiffen the tabs, increasing the force needed to pinch them together so they clear the abutments 50 and 52. Any sort of spring or resilient member can be used.

Figure 7:
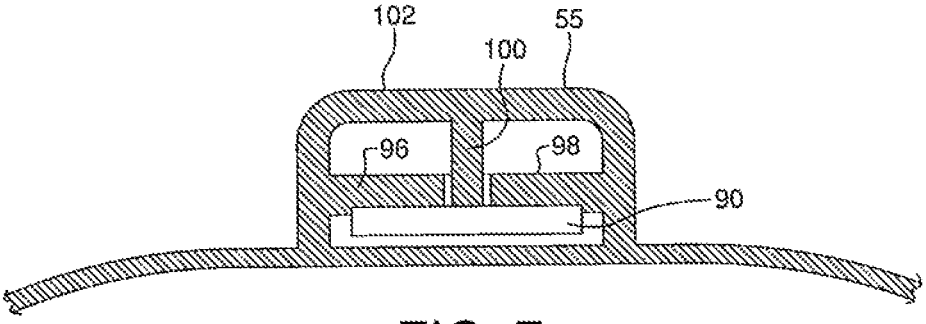
FIG. 7 is a bottom plan detail view of the child-resistant feature of FIG. 6.
Figure 8:
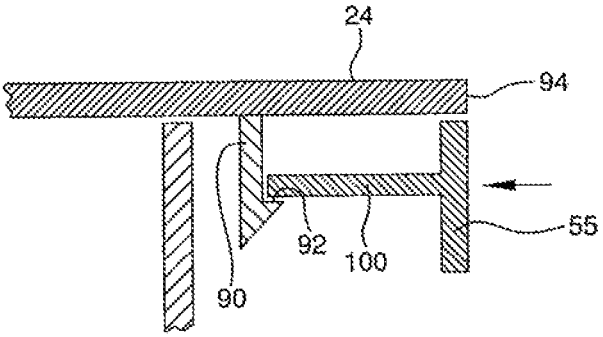
FIG. 8 is a section taken along section lines 8-8 of FIG. 6.
Figure 6:
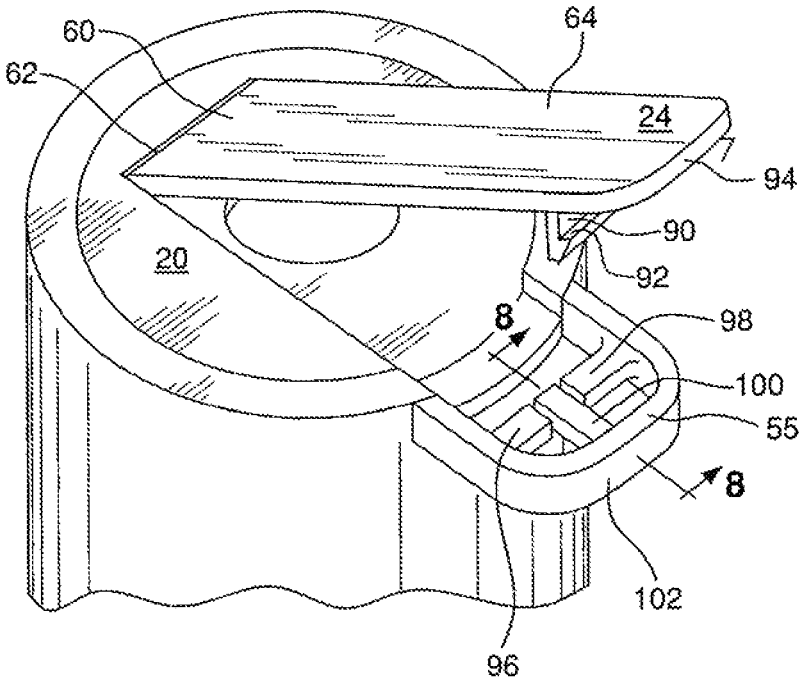
FIG. 6 is a view similar to FIG. 3 of another embodiment of the invention.

In another embodiment of the invention, shown in FIGS. 6, 7 and 8, one or more tabs 90 having an •upwardly facing abutment 92 protrude perpendicularly downward from the lid 24 when the lid is in its seated position. The tab is positioned back from the front edge 94 of the lid 24 so that the edge 94 of the lid extends beyond the tab 90.

A feature of the container, here a guard 55, protrudes from the side of the container that is a similar shape to the lid 24, but larger than the lid such that the lid 24 is recessed within the area defined by the feature when the lid 24 is closed. The tab 90 engages the underside of a rib, here defined by the rib portions 96 and 98, that is located within the area defined by the guard 55 protruding from the side of the container, which secures the lid 24. The rib portions 96 and 98 define a gap or an opening between them. The undersides of the rib portions 96 and 98, best seen in FIG. 7, define downward-facing abutments. The rib could also be provided in one piece with an aperture through it, though the illustrated construction may be easier to mold.

The guard 55 can be deformed inward. There is a mating rib or push rod 100 on the deformable portion 102 (the part the deforms need not be the part from which the rod 100 extends) that fits through the gap or opening between the rib portions 96 and 98, or through an aperture of a one-piece rib, and is positioned to bear against the tab 90 to deform the tab 90 inward when the deformable portion 102 is deflected inward.

To open the container, the guard 55 is displaced toward the body of the container, which translates the mating rib 100 inward along its axis through the opening between the rib portions 96 and 98, deflecting the tab 90 so that its upward facing abutment 92 no longer engages the rib portions 96 and 98. At the same time as the guard 55 is displaced, the underside or edge 94 of the lid is being exposed, allowing the edge 94 to be lifted with a thumb or finger so the lid 24 can be rotated upward, opening the container.

After use, the container can be closed by simply rotating the lid to the closed position and the tab(s) are shaped so that they fit through the protrusion or guard 55 and again engage the underside, securing the lid.

Figure 10:
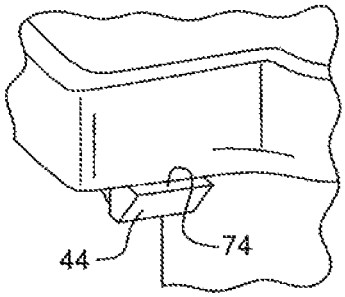
FIG. 10 is an isolated partial perspective view of the embodiments of FIGS. 3-5.

FIG. 10 is a detail view of a child-resistant feature similar to that of FIGS. 3-4.

Figure 12:
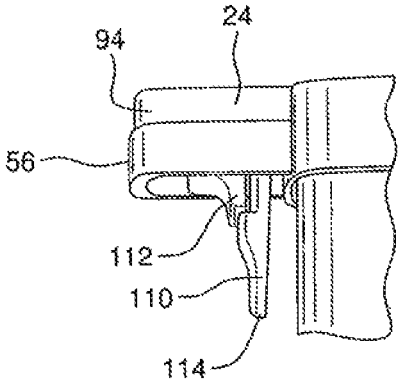
FIG. 12 is a view similar to FIGS. 4 and 6, showing another embodiment.
Figure 13:
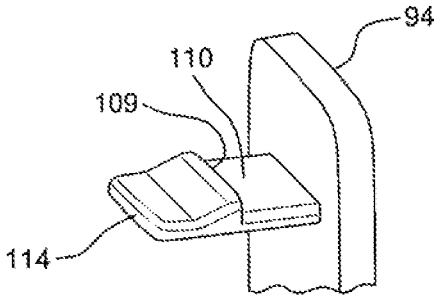
FIG. 13 is a partial perspective view of the tab shown in FIG. 12.

Another embodiment of the invention, shown in FIGS. 12 and 13, has one or more tabs 110 that protrude perpendicularly downwardly from the lid 24 when the lid is in its closed position. The tab 110 is positioned back from the front edge 94 of the lid 24 so that the edge 94 of the lid 24 extends beyond the tab 110. A feature or guard 56 of the container protrudes from the sidewall of the container and is similar in shape to the lid 24, but larger than the lid such that the lid is within' the area defined by the guard 56. The tab 110 has an upward facing abutment 109 that engages the underside of a rib 112 that extends downwardly from the guard 56, which secures the lid 24. The bottom of the rib 112 is a downward-facing abutment. To open the container, the tab 110 is displaced rearward by deflecting its distal portion 114 inward so that the upward-facing abutment 109 no longer engages the rib 112. It will be appreciated that a shield, similar to the shield illustrated in FIG. 11, could be provided to at least partially block or restrict access to the tab 110 to further limit the way in which the container can be opened.

After use, the container can be closed by simply rotating its lid to the closed position, and the tab(s) are shaped so that they fit through the guard 56 and again engage the underside of the rib 112, securing the lid.

Figure 14:
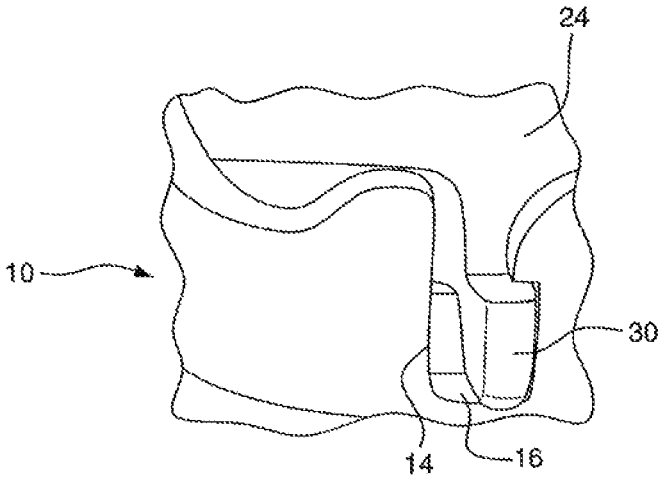
FIG. 14 is an alternative embodiment similar to the embodiment of FIGS. 1 and 2.

In another embodiment of the invention, shown in FIG. 14, the notches 16 are undercut to the rear, instead of forward, but otherwise the construction is similar to FIGS. 1-2, and corresponding reference characters are provided. The container wall covers the front edge of the lid so that there is no exposed edge. The tabs 30, of which there optionally are two, protrude beyond the wall of the container. To open the container, the tabs are first deflected away from the undercut part of the notch 16. While holding the tabs in this position, the lid 24 can be rotated upward so that the tabs 30 clear the notches.

After use the container can be closed by simply rotating the lid 24 to the closed position. The tabs 30 and notches 16 are shaped so that as the lid is closed, the tab is deflected past the undercut of the notch 16 and then snaps into the undercut when the lid 24 is completely closed.

Figure 15:
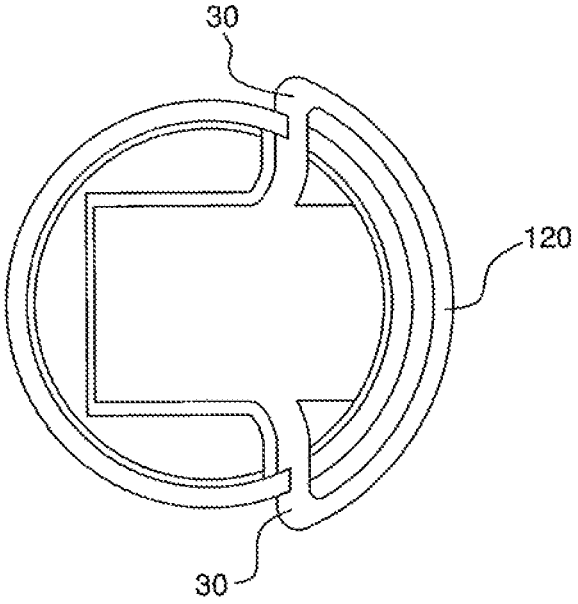
FIG. 15 is a diagrammatic plan view of the embodiment of FIG. 14, further including a bow member connecting the two side tabs.

In another embodiment, shown in FIG. 15, which is similar to the embodiment shown in FIGS. 1-2, the two side tabs 30 are connected together by a bow 120 such that a handle is formed to assist in pulling the side tabs 30 forward from a single point. The bow 120 can at the same time be lifted to open the lid 24.

Figure 16:
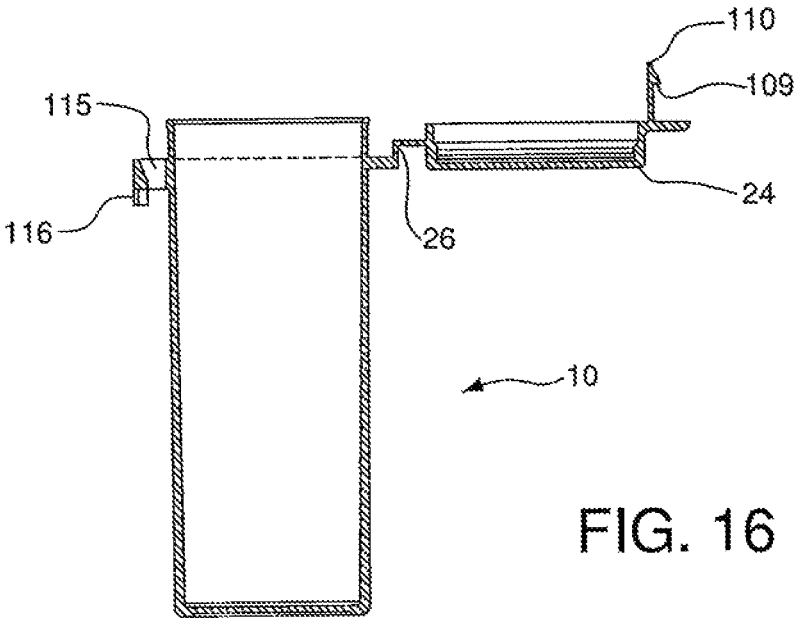
FIG. 16 is a cross-sectional side view of an alternative embodiment of the child-resistant container in an open position.
Figure 17:
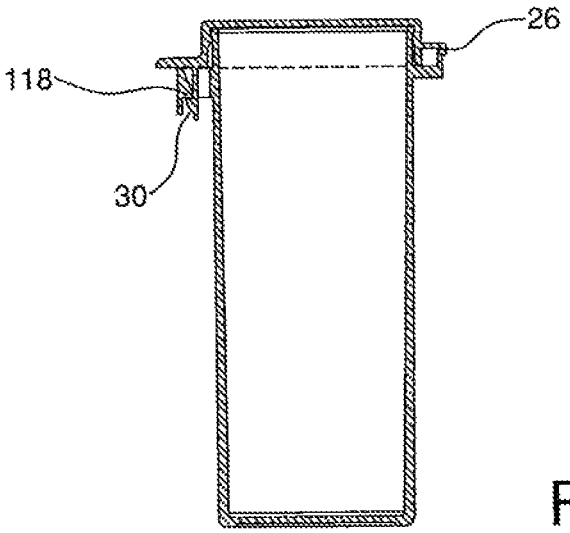
FIG. 17 is a view similar to FIG. 16 showing the container in a closed position.
Figure 18:
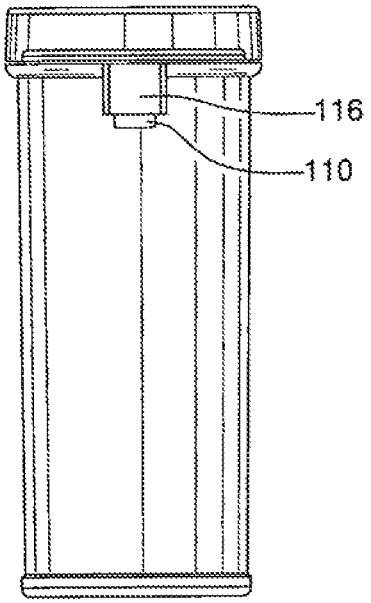
FIG. 18 is a front view of the container illustrated in FIG. 17.

Another embodiment of the invention, shown in FIGS. 16-18 and similar to the embodiment shown in FIGS. 12 and 13, has an abutment 115 protruding from the outer wall of the container. The abutment 115 includes a catch 118 for receiving the tab 110 which extends perpendicularly from the lid 24. The tab 110 includes an abutment 109 that engages the catch 118 to secure the lid 24 to the container. The abutment 115 on the container also includes a shield portion 116 that at least partially covers the tab 110 when the tab is engaged with the catch 118 to limit access to the tab 110.

To open the container, the tab 110 is flexed or moved back toward the container so that the abutment 109 no longer engages the catch 118. Once the abutment 109 clears the catch 118, the lid can be rotated upward about an axis through the hinge 26 to flip open the lid, as shown in FIG. 16. After use, the container can be closed by rotating the lid 24 back to its closed position. The tab 110 is shaped so that as the lid 24 is closed, the abutment 109 again engages the catch 118.

Figure 19:
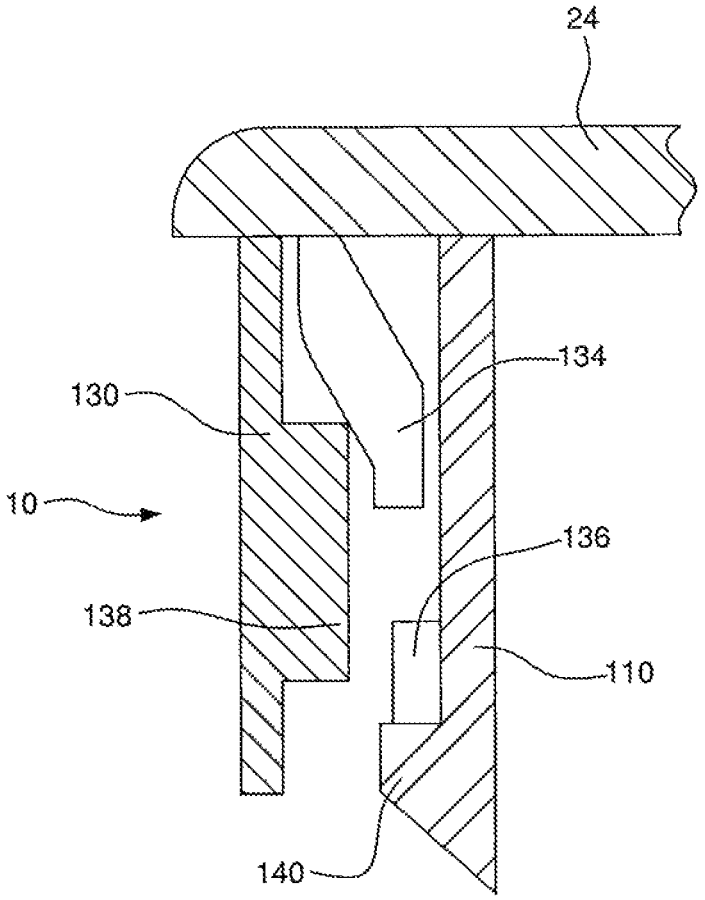
FIG. 19 is an isolated side view showing another embodiment of the child-resistant feature.

In another embodiment, shown in FIG. 19, the outer wall of the container has an abutment 130 that has a flexible portion and a catch 134. The tab 110 extends perpendicularly downward from the lid and, in this embodiment, is provided with a latch 136. The container is opened by first partially lifting the lid 24 so that the latch 136 of the lid engages catch 134 on the abutment. In this position when the abutment 130 is deflected inward, a rib 138 engages a step 140 on the tab and displaces the entire tab. This causes the latch 136 to be moved away from the catch 134, releasing the tab. The lid can be rotated about an axis through the hinge 26 to lip open the lid.

Figure 20:
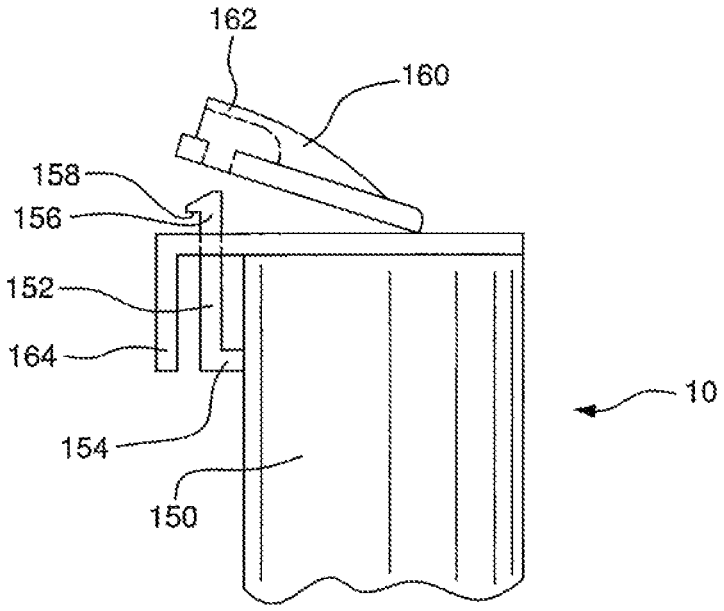
FIG. 20 is a side view of an alternative embodiment of the child-resistant container.

Another embodiment of a child-resistant container is illustrated in FIG. 20. In this embodiment, the container body 150 is provided with a resilient tab element The tab 152 is joined at its proximal end 154 to the container body, and has an upwardly extending distal portion 156 that is provided with a downward-facing abutment 158.

A lid 160 is joined to the container and has a raised portion 162 that at least partially covers the tab when the tab is in its closed and engaged position. Preferably, the raised portion has an open-faced half-dome shape, although other designs could be employed. Within the raised portion is a rib or catch which receives the downward-facing abutment 158 of the tab 152 to secure the lid 160 to the container body. In order to protect the tab from accidental release and to restrict access to the tab, a shield 164 is mounted on the container body such that the shield overlies at least a portion of the tab 152.

To open the container, the distal portion 156 of the tab 152 is deflected toward the container so that the downward-facing abutment of the tab moves into the domed area of the lid and clears the catch. Once the tab clears the catch, the lid can be lifted up to access the container.

The invention has now been described in such full, clear, concise and exact terms as to enable any person skilled in the art to which it pertains to practice the same. It is to be understood that the foregoing describes preferred embodiments and examples of the invention, and that modifications may be made therein without departing from the spirit or scope of the invention as set forth in the claims.

We claim:

1. A child-resistant container comprising:

a container body having a mouth configured to provide access to an interior of the container body and a ring protruding outwardly from a sidewall of the container body and proximal a top end of the container body, the ring including at least one downwardly-facing abutment; and a lid pivotally mounted to the container body by a hinge, the lid being pivotable between a seated position, wherein the lid covers the mouth of the container body, and a raised position, wherein the mouth is at least partly exposed, at least a portion of the lid nesting in the ring when the lid is in the seated position, the lid including at least one resilient tab having a proximal portion fixed to the lid at a location spaced inwardly from an outer periphery of the lid and a distal portion projecting from the lid, the distal portion including at least one upward-facing abutment, when the lid is in the seated position the upward-facing abutment is biased at least partly beneath and into engagement with the downward-facing abutment of the ring, wherein an upper most surface of the lid is coplanar with an upper most surface of the ring when the lid is in the seated position.

2. The child-resistant container of claim 1, wherein the at least one resilient tab includes two resilient tabs each having an upward-facing abutment, and wherein the at least one downwardly-facing abutment of the ring includes two downwardly-facing abutments, each upward-facing abutment being aligned with and engaging one of the opposing downward-facing abutments when the lid is in the seated position.

3. The child-resistant container of claim 2, wherein the downward-facing abutments and the upward-facing abutments comprise substantially horizontal engagement surfaces.

4. The child-resistant container of claim 2, wherein each of the upward-facing abutments is spaced radially forward relative to the sidewall of the container body when the lid is in the seated position, and wherein each upward-facing abutment is biased into an engagement position with a corresponding one of the downward-facing abutments when the lid is in the seated position, thus latching the lid closed.

5. The child-resistant container of claim 4, wherein the lid is openable by engendering a first motion and a second, opposing motion, each motion being between a respective upward-facing abutment relative to the corresponding downward-facing abutment in a direction of a biasing force that maintains a respective engagement position, until the upward-facing abutments are disengaged from the downward-facing abutments, thus allowing the distal portion of the lid to be pivoted about the hinge to move the lid to the raised position.

6. The child-resistant container of claim 1, wherein the lid comprises a sealing plug disposed within the mouth of the container body when the lid is in the seated position.

7. The child-resistant container of claim 6, wherein the sealing plug is configured to provide a moisture ingress rate for the container of less than 1500 micrograms per day, at 80% relative humidity and 72° F. (21° C.).

8. The child-resistant container of claim 1, wherein the ring includes a depending shield configured to limit access to the at least one resilient tab.

9. The child-resistant container of claim 1, wherein the at least one resilient tab extends perpendicularly downward from a side edge of the lid when the lid is in the seated position.

10. The child-resistant container of claim 1, wherein in order to move the lid from the seated position to the raised position, the at least one resilient tab is deflected inward away from the ring.

11. A child-resistant container comprising:

a container body having a mouth configured to provide access to an interior of the container body and a ring protruding outwardly from a sidewall of the container body and proximal a top end of the container body, the ring including at least one downwardly-facing abutment; and a lid pivotally mounted to the container body by a hinge, the lid being pivotable between a seated position, wherein the lid covers the mouth of the container body, and a raised position, wherein the mouth is at least partly exposed, at least a portion of the lid nesting in the ring when the lid is in the seated position, the lid including at least one resilient tab having a proximal portion fixed to the lid and a distal portion projecting from the lid, the distal portion including at least one upward-facing abutment, when the lid is in the seated position the upward-facing abutment is biased at least partly beneath and into engagement with the downward-facing abutment of the ring, wherein the at least one resilient tab includes two resilient tabs connected by a spring configured to hold the tabs in position to maintain the lid in the seated position and permit a force needed to move the lid from the seated position to the raised position.

12. A child-resistant container comprising:

a container body, a ring protruding outwardly from a sidewall of the container body; and a lid pivotally attached to the container body by a hinge, the lid including two opposing resilient tabs extending from the lid each at a location spaced inwardly from an outer periphery of the lid, at least a portion of each resilient tab being biased to engage at least a portion of the container body when the lid is in a seated position on the container body, an upper most surface of the lid being coplanar with an upper most surface of the ring when the lid is in the seated position.

13. The child-resistant container of claim 12, wherein the lid is pivotable between the seated position, wherein the lid covers a mouth of the container body, and a raised position, wherein the mouth of the container body is at least partly exposed.

14. The child-resistant container of claim 12, wherein a ring protrudes radially forward from a sidewall of the container body and proximal a top end of the container body, the ring including two downwardly-facing abutments, each resilient tab including an upwardly-facing abutment.

15. The child-resistant container of claim 14, wherein at least a portion of the lid is configured to nest in the ring when the lid is in the seated position.

16. The child-resistant container of claim 14, wherein when the lid is in the seated position each upward-facing abutment is biased at least partly beneath and into engagement with one of the downward-facing abutments.

17. The child-resistant container of claim 14, wherein the upward-facing abutments are aligned with and engage the opposing downward-facing abutments when the lid is in the seated position.

18. The child-resistant container of claim 14, wherein the ring includes a depending shield configured to limit access to the tabs.

19. The child-resistant container of claim 12, wherein the lid comprises a sealing plug disposed within the mouth of the container body when the lid is in the seated position, the sealing plug being configured to provide a moisture ingress rate for the container of less than 1500 micrograms per day, at 80% relative humidity and 72° F. (21° C.).

20. A child-resistant container comprising:

a container body; and a lid pivotally attached to the container body by a hinge, the lid including two opposing resilient tabs extending from the lid, at least a portion of each resilient tab being biased to engage at least a portion of the container body when the lid is in a seated position on the container body, wherein the two opposing resilient tabs are connected by a spring configured to hold the tabs in position to maintain the lid in the seated position and permit a force needed to move the lid from the seated position to a raised position.

* * * * *